US006302503B1

(12) United States Patent
Seu

(10) Patent No.: US 6,302,503 B1
(45) Date of Patent: Oct. 16, 2001

(54) INKJET INK LEVEL DETECTION

(75) Inventor: Preston D. Seu, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/181,953

(22) Filed: Oct. 28, 1998

Related U.S. Application Data

(63) Continuation-in-part of application No. 09/070,898, filed on Apr. 30, 1998.

(51) Int. Cl.[7] ..... B41J 2/195; B41J 2/175
(52) U.S. Cl. ..... 347/7; 347/86
(58) Field of Search ..... 347/7, 19, 85, 347/86, 93, 75, 49, 23, 28

(56) References Cited

U.S. PATENT DOCUMENTS

| | | |
|---|---|---|
| 4,432,005 | 2/1984 | Duffield et al. . |
| 5,079,570 | 1/1992 | Mohr et al. . |
| 5,136,305 | 8/1992 | Xerox Corporation . |
| 5,745,138 | 4/1998 | Ostermeier . |

FOREIGN PATENT DOCUMENTS

| | | |
|---|---|---|
| 0 624 476 | 11/1994 | (EP) . |
| 0 706 888 | 4/1996 | (EP) . |
| 0 803 364 | 10/1997 | (EP) . |
| 0 832 748 | 4/1998 | (EP) . |
| WO97/16314 | 5/1997 | (WO) . |

OTHER PUBLICATIONS

European Patent Office, European Search Report, Jul. 28, 1999.

*Primary Examiner*—John Barlow
*Assistant Examiner*—Charles W. Stewart, Jr.
(74) *Attorney, Agent, or Firm*—H. Brian Davis

(57) ABSTRACT

An inkjet printing system includes a permanent or semi-permanent inkjet pen containing small glass beads for ink containment and to provide backpressure to the ink. The inkjet pen walls are transparent, and the printer has an optical sensor that detects changes in reflectivity in the glass beads. The glass beads change in reflectivity depending on whether or not they are saturated with ink. The change in reflectivity therefore functions as an effective out-of-ink detector. When an out of ink indication is made, the printer executes a refill of the pen. Two embodiments of refill mechanisms are disclosed: a trailing tube design, and a take-a-sip design.

11 Claims, 5 Drawing Sheets

INKJET INK LEVEL DETECTION

RELATED CASE INFORMATION

This application is a continuation in part of co-pending Ser. No. 09/070,898, filed Apr. 30, 1998, and entitled Inkjet Ink Containment Device and Method.

BACKGROUND OF THE INVENTION

1. Field of the Invention

The present invention is directed to an inkjet printing system and method having an ink level detection system that uses changes in optical characteristics of a capillary ink containment material.

2. Description of the Related Art

Inkjet printers operate by ejecting small droplets of ink from a printhead onto a print medium. The printhead is mounted in an inkjet pen, which is held in the printer at the appropriate position with respect to the media. The ink must be presented to the printhead at the appropriate "backpressure," (i.e., less than ambient atmospheric pressure) to keep the ink from drooling from the printhead when the pen is not operating. Various mechanisms have been employed to contain the ink at the appropriate backpressure, including resilient elastomeric bladders, porous foam, internal accumulators, bubble generators, and spring-biased flexible bags. When the ink is depleted from the pen, it may advantageous or necessary to automatically sense the empty condition of the pen. For example, the system may be designed to automatically refill the pen by means of a flexible trailing tube or an automated refill station. In addition, damage may be done to the printhead if it is operated when the pen is empty.

Various mechanisms have been devised to sense the level of ink in inkjet pens. U.S. Pat. No. 5,751,300 (Cowger et al.), assigned to the present assignee, discloses an ink level sensor used in a trailing tube printer. A pair of electrical leads are implanted in a body of foam, and the current between the leads indicates ink level. The level of ink is used to operate a valve that controls the amount of ink allowed into the pen. U.S. Pat. No. 5,079,570 (Mohr et at.), assigned to the present assignee, discloses a binary fluidic indicator in a disposable print cartridge that uses a small tube or other element formed on the ink tank of an inkjet print cartridge. The main ink tank of the print cartridge is filled with a porous material such as polyurethane foam. This patent also mentions as alternative ink containing members: glass beads, felt pen fibers, capillary tubes, and rolled up plastic film (column 4, lines 15–18). The small element that provides the optical ink level indication does not contain the capillary material. When the ink level drops to a certain level, the capillary material draws the ink from the indicator, to thus provide a binary indication that the ink has dropped to a selected level. The indicator can be either human or machine readable. U.S. Pat. No. 5,406,315 (Allen et al.), assigned to the present assignee, discloses an optical sensor that detects the temperature and ink level based on changes in the reflectivity of a phase change material adjacent to or within the pen body housing.

Despite the above-mentioned and other ink level detection mechanisms, there remains a need for an inexpensive and reliable system for automatically detecting the level of ink in inkjet pens.

SUMMARY OF THE INVENTION

The present invention provides an inkjet printing system that includes an inkjet printhead and an pen housing having walls and configured to fluidically connect to the printhead. A body of particles is disposed in the pen housing, and ink is disposed in the particles. The particles have a first reflectivity when saturated with ink and a second reflectivity when not saturated with the ink. A transparent window is formed one of the walls of the pen housing to provide optical access to the particles. An optoelectronic sensor is optically coupled to the pen housing and configured to detect the first reflectivity and the second reflectivity and to output the results of the detection. In a preferred embodiment, an ink tank is fluidically coupled to the pen housing and configured to supply additional ink into the pen housing.

The invention also provides a method of providing ink to an inkjet printhead. This method includes the steps of: (a) filling ink into glass beads, which are fluidically coupled to and supply ink to the printhead; (b) optically monitoring the reflectivity of the glass beads; (c) optically detecting a change in reflectivity of the glass beads when ink in the glass beads is depleted and producing an electronic signal to indicate the change in reflectivity; and (d) refilling ink into the glass beads based on the signal.

The invention thus provides an efficient and reliable mechanism and method for determining an out of ink condition in an inkjet pen.

DETAILED DESCRIPTION OF THE ILLUSTRATED EMBODIMENT

Figure 1:
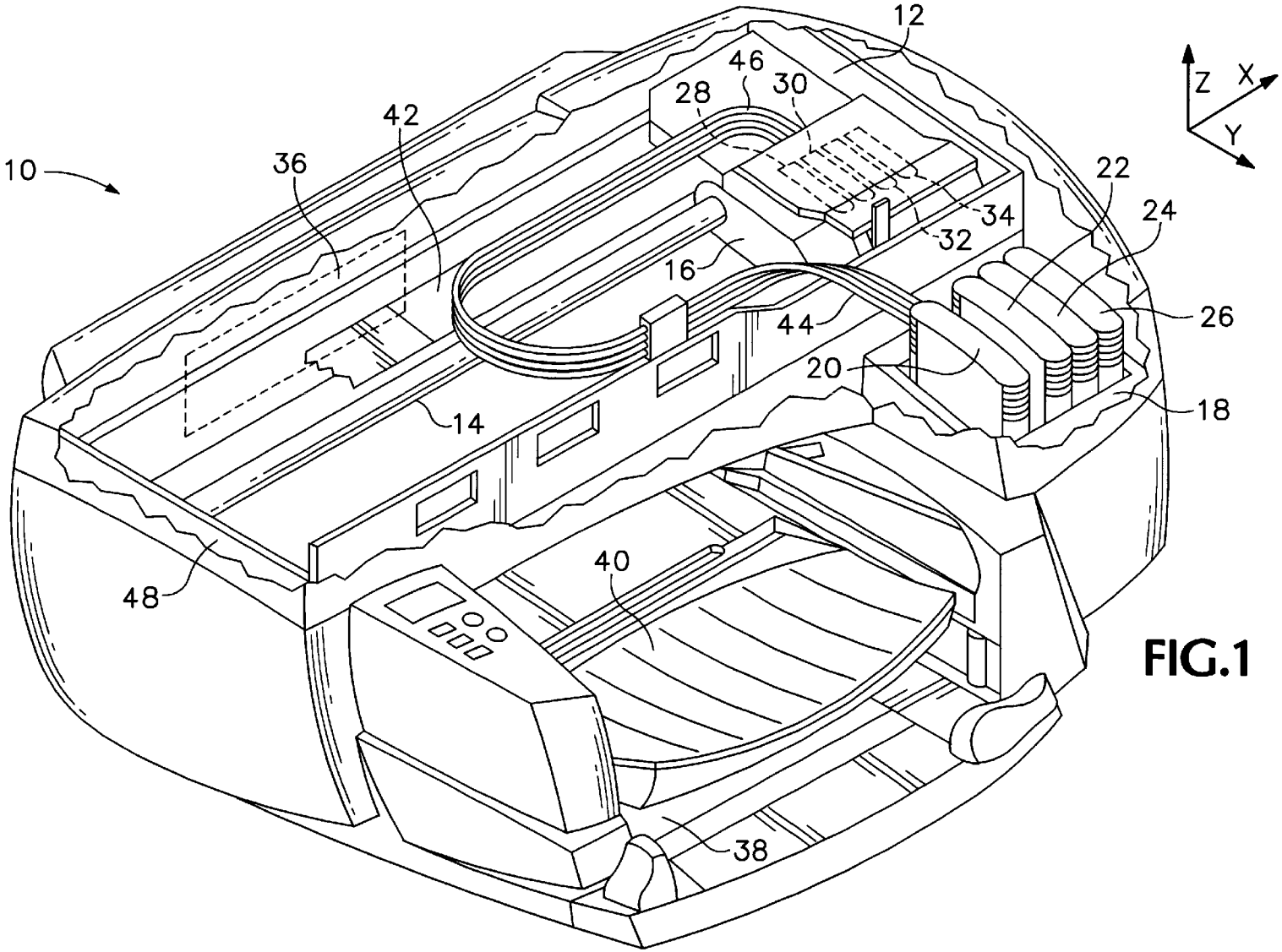
FIG. 1 is a perspective view of a printing system of the invention.

FIG. 1 illustrates a trailing tube embodiment of a printing system of the invention. This printing system includes a printer 10 having a chassis 12, carriage rod 14, carriage 16, ink cartridge stall 18, ink tanks 20, 22, 24, 26, pens 28, 30, 32, 34 (shown in phantom lines), and controller 36. Also attached to chassis 12 is an input paper tray 38 and an output paper tray 40. Controller 36 is communicatively connected to a host printing device (not shown), such as a personal computer, from which it receives data signals representative of the image and/or text desired to be printed. Controller 36 is also communicatively connected with pens 28, 30, 32, 34 and to a medium-advance motor and a carriage advance motor (not shown). Carriage 16 rides upon rod 14 as it scans back and forth across the print media.

At the appropriate time, controller 36 actuates the carriage advance motor to drive carriage 16 in the carriage advance axis X to scan pens 28, 30, 32, 34 over the current swath on a sheet 50 of print medium. As pens 28, 30, 32, 34 are scanned across the print medium, the printheads are addressed by controller 36 to expel droplets of ink in the desired dot matrix pattern across the page. After a scan is complete, controller 36 sends a signal to the medium-advance motor to advance the sheet incrementally in the medium advance direction Y so that the pens can begin another pass. Multiple adjacent horizontal passes are printed in this manner to complete the printing of the desired image on the page.

Ink is fed from the ink tanks 20, 22, 24, 26 by means of tubes 46 to pens 28, 30, 32, 34. When any one of the ink tanks is depleted of ink, it is replaced with a new ink tank. At some point one of the pens 28, 30, 32, 34 may become degraded. In this case, the degraded pen can also be replaced, either by the user or a trained technician.

Figure 2:
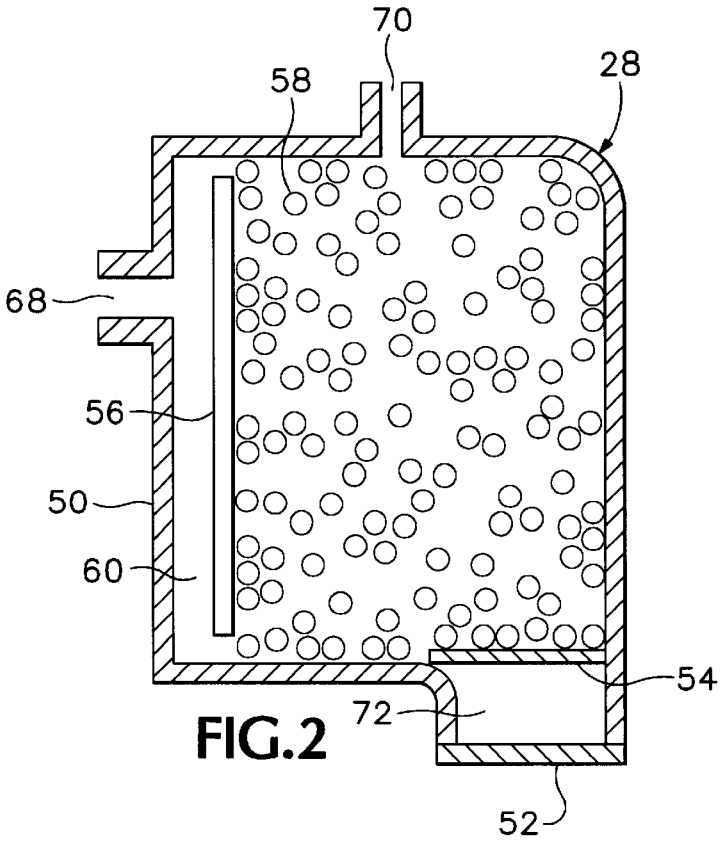
FIG. 2 is a perspective illustration of a pen and optical sensor of the invention.

FIG. 2 illustrates pen 28, which consists of an outer housing 50, printhead 52, mesh filter 54, internal wall 56, and glass beads 58. The exterior walls of housing 50 are made of a transparent high density polyethylene or polypropylene. As shown interior wall 56 defines a small secondary cavity 66. Pen 58 has an input port 68 for receiving ink and an air vent 70. The main portion of the pen body is filled with glass beads 58, as shown. Port 68 is fluidically connected to one of tubes 46 (see FIG. 1), which is in turn connected to ink cartridge 20.

Filter 54 keeps glass beads 58 from filling into the small sub-chamber 70 just above the printhead 52. The filter 54 also keeps foreign particles and air from reaching the printhead. Air that reaches the filter 54 through the beads 58 is stopped by the filter. Filter 54 is preferably formed of stainless steel wire mesh, and has pores of about 20 microns. Ink saturated glass beads surround the volume near the filter screen. Wetted but only partially saturated beads extend out from this volume. The partially filled beads contain the ink-to-air interfaces that produce the negative pressure. The interface between partially saturated beads and saturated beads moves toward the filter screen as the ink is fired through the printhead. When filter 54 is wetted, the filter has a large "bubble pressure" that keeps bubbles from passing through it. Ink passes preferentially through the screen where the screen contacts saturated beads.

Glass beads 58 have an average diameter of about 0.012 inches, and have a range from about 0.010 to about 0.016 inches in diameter. In the presence of typical inkjet inks these beads produce a backpressure of about 1.5 inches of water. The size of the beads can be adjusted to meet the backpressure needs of the printhead.

As discussed below, ink flowing into pen 28 from the tube is pressurized by a pumping mechanism (not shown). Ink flowing into pen 28 fills first into small chamber 60, from where it is absorbed into beads 58. It has been found that flowing ink into the bottom of the pen is less likely to raise the pressure of ink presented to the printhead 52 than if the ink were flowed to the top of beads 58.

Figure 3:
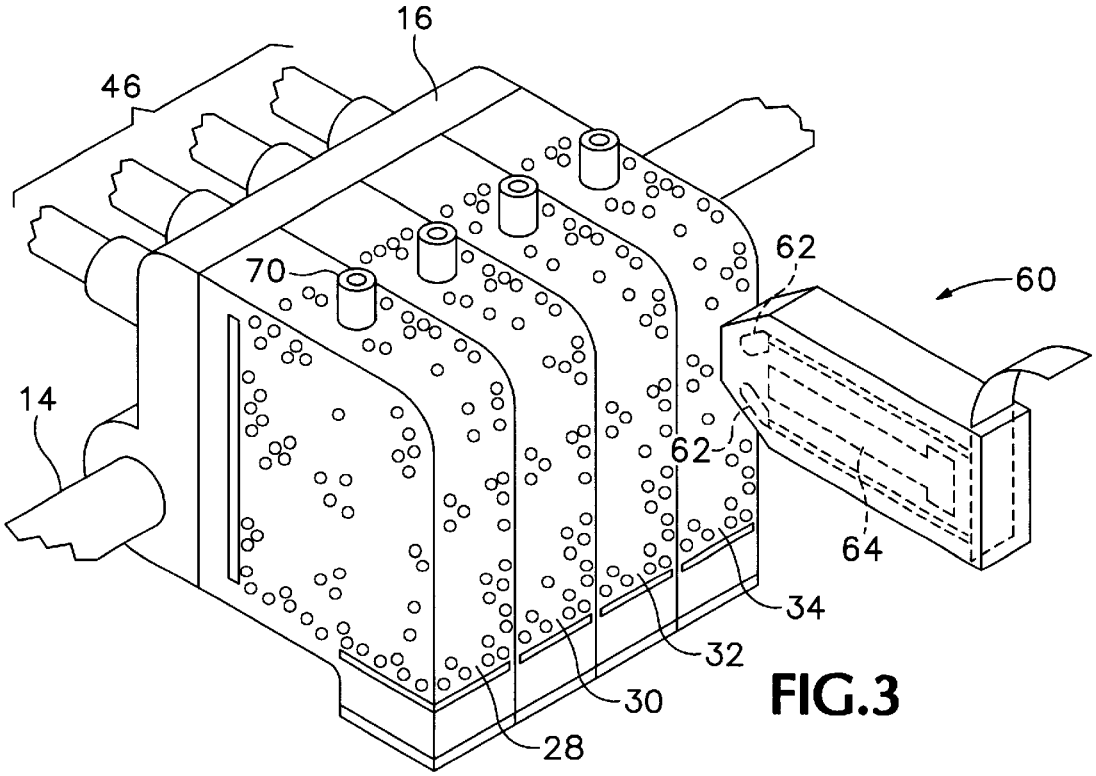
FIG. 3 is perspective illustration of a pen, carriage, and optical sensor assembly of the invention.

FIG. 3 illustrates pens 28, 30, 32, 34 connected to carriage 16. Ink level detector 60 is positioned to detect the change in reflectivity from beads 58 in each of the pens. Ink level detector 60 is comprised of two Hewlett-Packard Company blue (481 nm) light emitting diodes (LED's) 62 and a photodetector 64. Photodetector 64 is a Texas Instruments TLS 250, which is composed of a photodiode and a transimpedence amplifier. Photodetector 64 is electronically linked to controller 36. Carriage 16 scans each of pens 28, 30, 32, 34 past a position where the LED's 62 can illuminate the pens, and where photodetector 64 can detect the reflectivity of the glass beads. Photodetector 64 and LED's 62 are mounted near the right hand side of printer 10 as viewed in FIG. 1, but is not visible in FIG. 1.

An important feature of the glass beads chosen is that they exhibit a change in reflectivity depending on whether there is ink present in the beads. When the glass beads are not saturated with ink, they are white in appearance and look somewhat like snow. When they are saturated with ink, they take on the appearance of the ink. When the beads are no longer saturated, they take on a very pale version of the ink color, and are much more reflective. To the eye, this change is quite easily detected. As discussed below in reference to FIGS. 6–9, testing has indicated that for each of the ink colors, cyan, magenta, yellow and black, detectable changes in reflectivity occurs in the glass beads between their saturated state to their non-saturated state, so that this change in reflectivity can be optically detected by an optoelectronic sensor.

Another important characteristic of the glass beads is their ability to maintain the ink at the appropriate backpressure. The ability of a capillary element to provide a capillary pressure results from the interaction of three physical components, a liquid, a solid, and a gas. For the present purposes, The liquid is the inkjet ink, the solid is the capillary material, and the gas is air. Capillary pressure depends on the of surface tension the liquid, cohesion of the liquid molecules among each other, and the adhesion of the liquid molecules with the solid forming the capillary element. An important way of measuring the molecular interaction between the liquid and the solid forming the capillary element is the contact angle θ that will occur when the liquid is placed on the solid.

The wall material of high-density polyethylene has a higher contact angle with ink than the glass beads. This means that the polyethylene is less wettable by the ink than the glass beads. This fact is important to the function of the out-of-ink sensor. An easily wetted window may remain coated with an ink film and therefore mask the reflectivity (and therefore the ink saturation) of the glass beads.

When selecting the capillary materials for the pen, it is desirable to consider not only the static differential capillary heads but also the dynamic resistance to ink flow. It is important to refill the pen quickly in case the refilling must be accomplished in the middle of a print job. In general, a very wettable porous media is desired in order decrease resistance to fluid flow. A very wettable material, one with a very low contact angle, reduces resistance to flow in two ways. First, it allows larger void size and often a larger permeability for a given capillary head. The measure of the ability of a capillary member, such as a capillary tube or a porous material, to draw liquid upward from a given level against the force of gravity is referred to as its "capillary head." In general, capillary head can be described by the following equation:

$$h = \frac{\sigma}{\rho g}\frac{L_p}{A_p}\cos\theta \tag{1}$$

where:

$L_p$=the wetted perimeter of the void containing the meniscus $A_p$=the wetted area of the void occupied by the meniscus σ=the surface tension of the liquid ρ=the density of the liquid.

θ=the contact angle of the liquid on the capillary material.

g=the gravitational constant

A small ratio of $L_p/A_p$ corresponds to a large void size and often correlates to a large permeability. A less wettable material (one for which the cos θ term is small) must have a larger ratio of $L_p/A_p$, and a correspondingly smaller void size and lower permeability, than a more wettable material in order to achieve the same capillary head. Small pore size and low permeability may result in unacceptable pressure loss and inadequate ink flow at high ink flow rates.

A second way in which a very wettable material may reduce resistance to ink flow is by reducing the threshold pressure necessary to initiate movement in the ink menisci of the porous media. It has been noted that menisci in porous media tend to exhibit hysteresis in which they resist movement of the air/liquid interface until a threshold pressure is reached. This phenomenon can be observed on raindrops which stick to a windshield. The magnitude of this resistance increases with increasing contact angle. In other words, for a given liquid (ink for example) the resistance to meniscus movement is higher for porous media which are less wettable.

Glass beads are a good porous medium for the ink. Glass has a low contact angle with liquids such as water, alcohol, carbon tetrachloride, xylene, glycerin an acetic acid. The low advancing liquid contact angles are helped by the clean and smooth surfaces available with glass beads. Tests show a capillary pressure that is more consistent than foam during imbibation and drainage.

Figure 4:
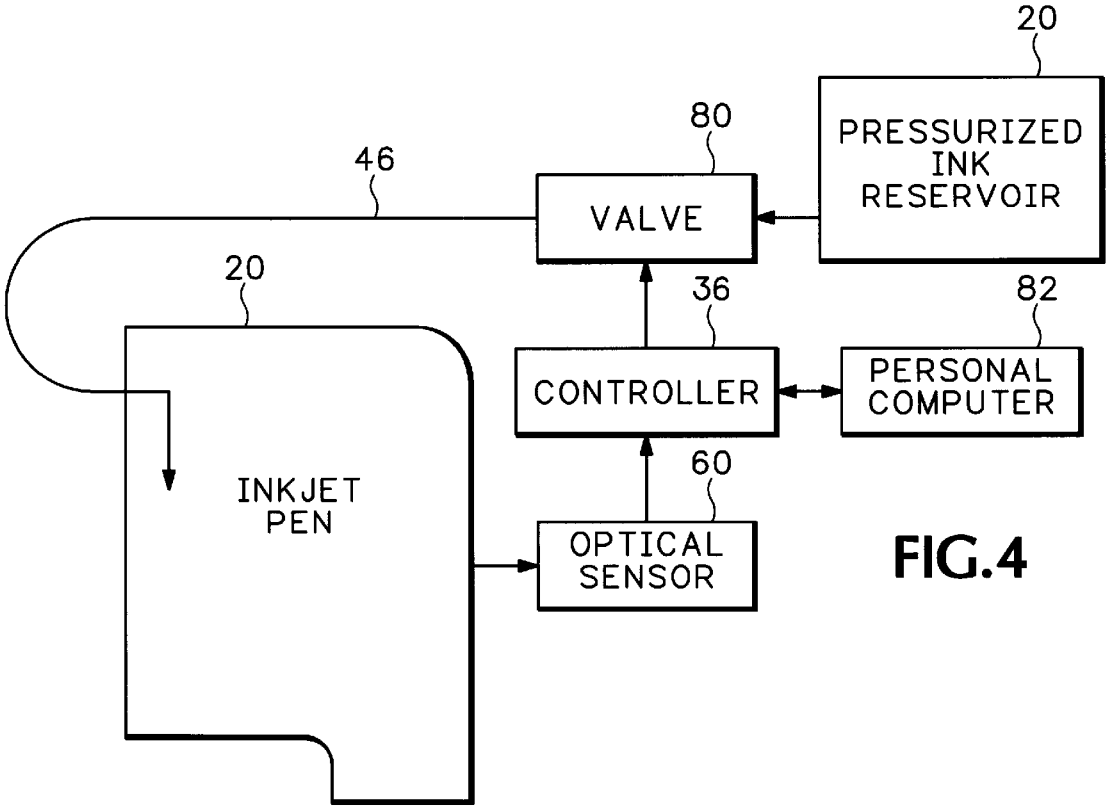
FIG. 4 is a schematic illustration of the printing system of FIG. 1.

FIG. 4 is a schematic representation of a printing system of the invention, and includes pen 28, optical sensor 60, pressurized ink reservoir 20, valve 80, and tube 46. A personal computer 82 is communicatively linked to controller 36. When optical sensor 60 detects a low ink level, a signal indicating such is sent to controller 36. Based on this signal, controller opens valve 80 to allow pressurized ink to flow to pen 28.

Controller 36 actuates valve 80 to open and allow a preselected amount of ink to fill pen 28. This amount is selected to be enough to fill the pen to a full state from the low state at which a low ink level is detected. The amount required to refill the pen is approximately the same each time because the low level detection is made at approximately the same low level. The printing system then can print again until another low ink level is sensed. When the low ink level is sensed, controller 36 again opens valve 80 to refill pen 28. This process continues until the ink reservoir is empty. When the ink reservoir 20 is empty, it is discarded and replaced with a new one.

Figure 5:
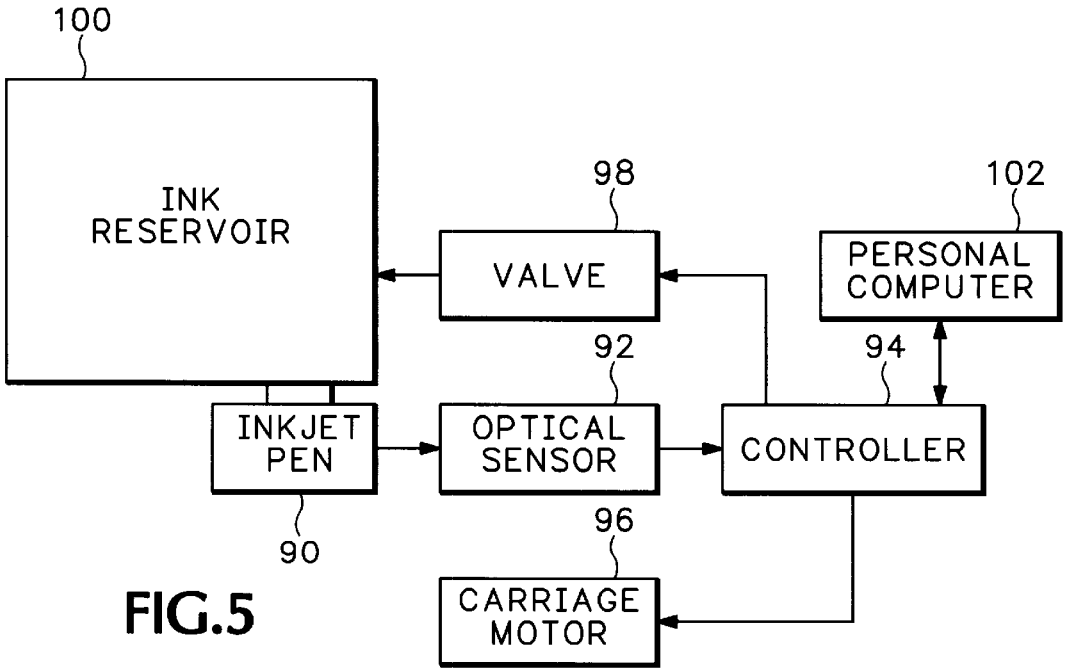
FIG. 5 is a schematic illustration of an alternative printing system of the invention.
Figure 6:
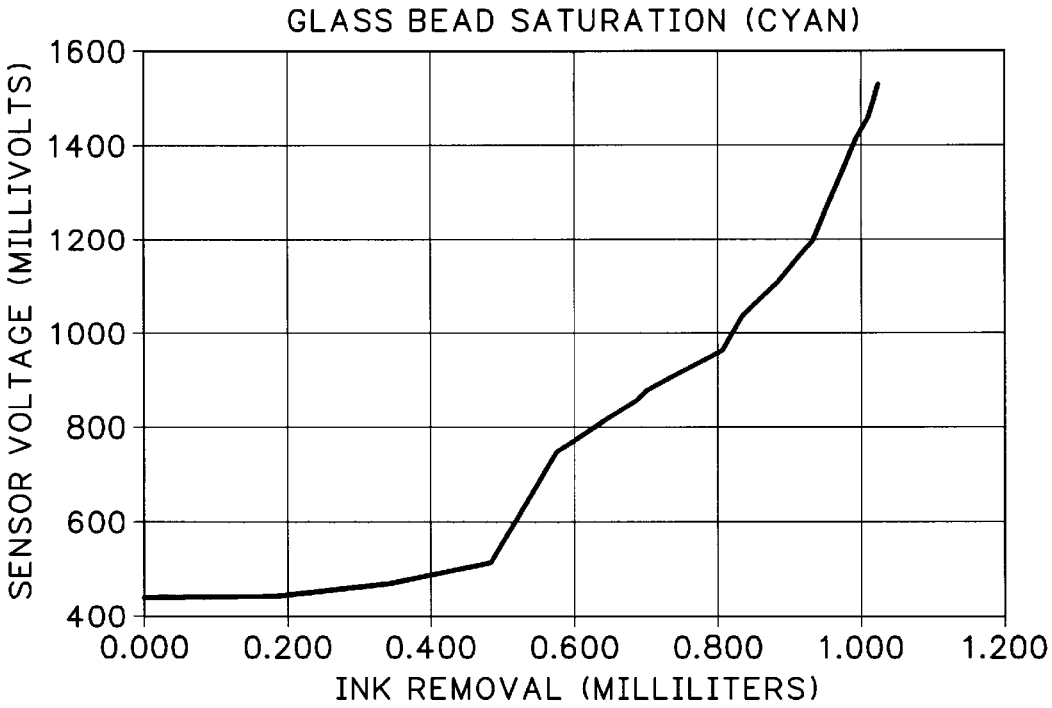
FIG. 6 is a graph of ink level sensor voltage versus ink depletion for cyan ink.
Figure 7:
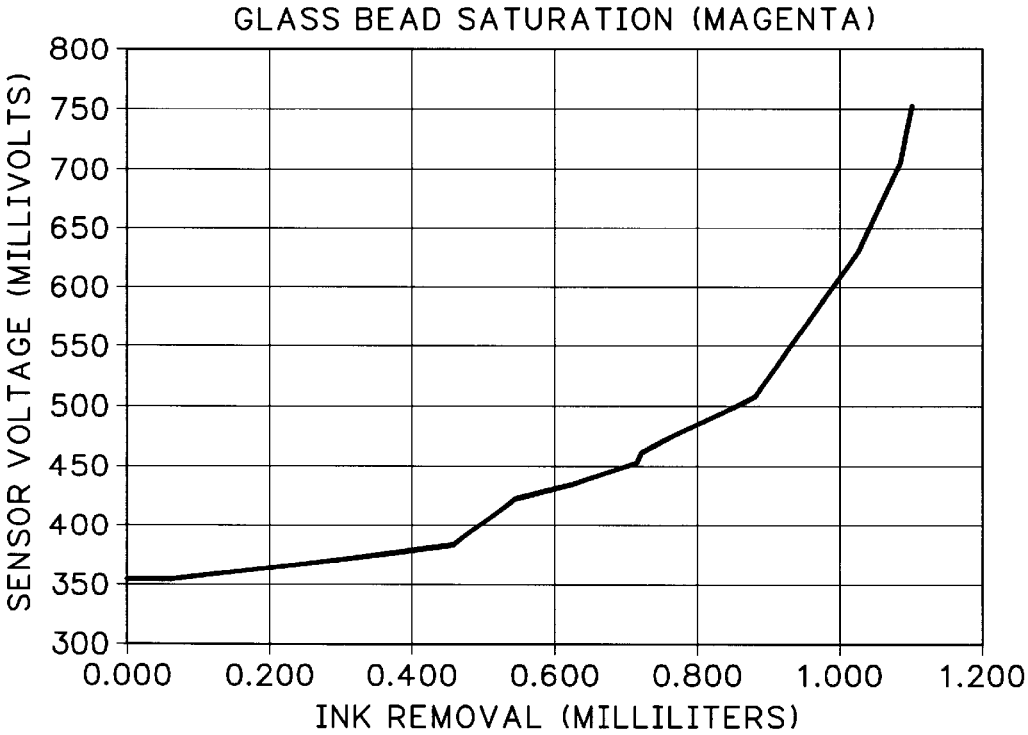
FIG. 7 is a graph of ink level sensor voltage versus ink depletion for magenta ink.
Figure 8:
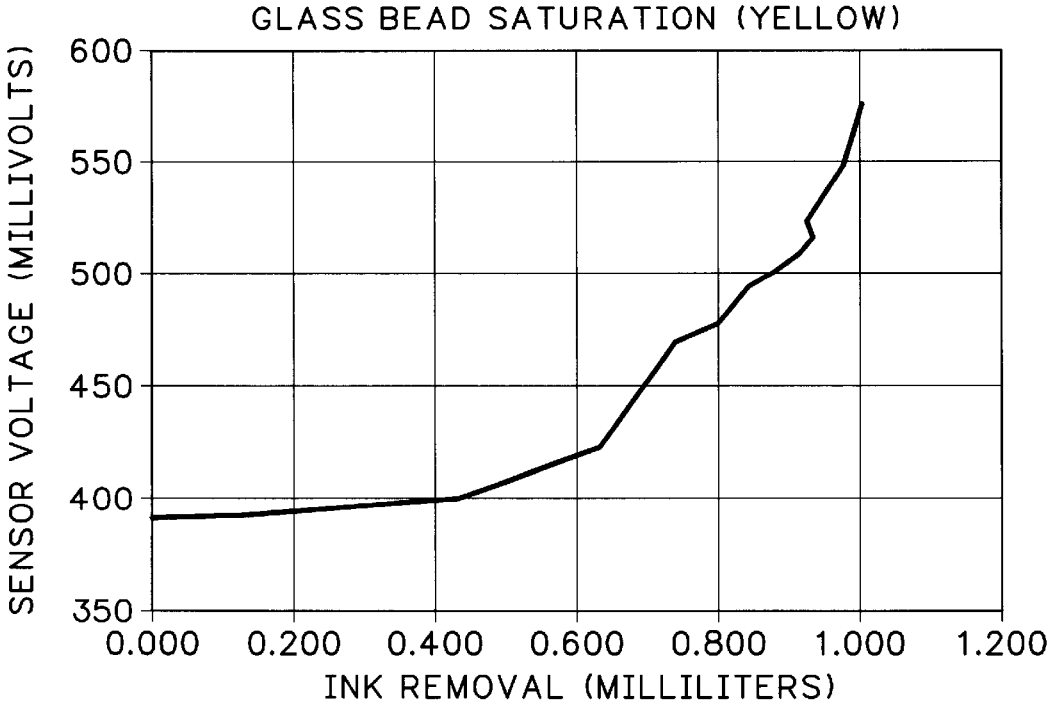
FIG. 8 is a graph of ink level sensor voltage versus ink depletion for yellow ink.
Figure 9:
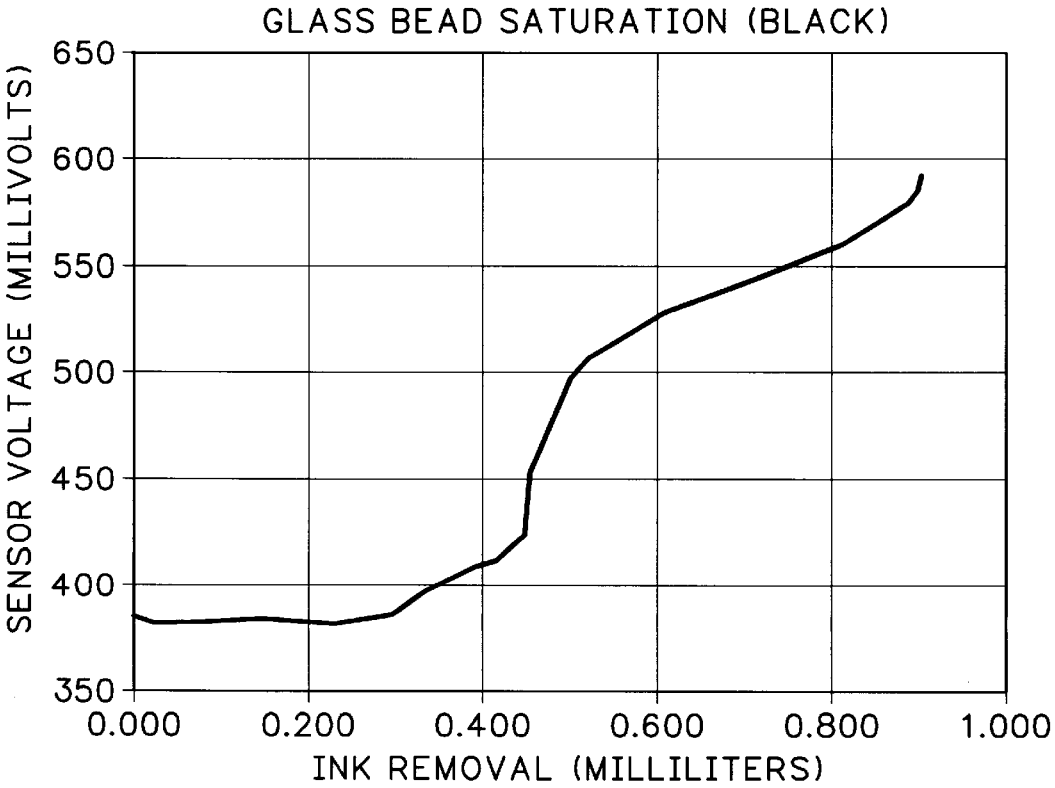
FIG. 9 is a graph of ink level sensor voltage versus ink depletion for black ink.

FIG. 5 is a schematic representation of an intermittent-fill or "take-a-sip" embodiment of a printing system of the invention. Only a single pen and ink tank described, but it will be understood that this discussion is representative of multiple pens, as discussed in reference to FIGS. 1–4. This printing system includes pen 90, optical sensor 92, controller 94, carriage motor 96, valve 98, and ink tank 100. Controller 94 is also communicatively linked to a personal computer 102. Inkjet pen 90 has transparent walls and is filled with glass beads. Optical sensor 92 optically detects the ink level in pen 90 by means of a change in reflectivity of the glass beads. When a low ink level is detected, controller 94 sends a signal to carriage motor 96 to position pen 90 in fluidic contact with ink tank 100. When pen 90 is in this position, controller 94 actuates valve 98 to cause ink tank 100 to refill pen 90.

FIGS. 6 through 9 are graphs of the voltage readouts from ink sensor 60 as a function of ink depletion from, respectively, the cyan, magenta, yellow, and black pens 28, 30, 32, 34. The ink removal is given in milliliters and the sensor voltage is given in millivolts. As can be seen from these graphs, a definite change in sensor voltage occurs as ink leaves the pens. When the ink tanks are full such that the beads are fully saturated with ink, the voltage sensor level is of all colors is between about 350 and 400 millivolts. This low voltage level represents a first reflectivity of the glass beads. As ink is depleted from the pens, the saturation of the beads becomes less, their reflectivity increases, and the voltage level of the sensor increases. The controller may be programmed to select a specific voltage level for the out-of-ink condition. For example, 500 millivolts may be selected as the out-of-ink condition for all colors. Alternatively, each color may have its own unique threshold level. For example, given the voltage output levels shown in FIGS. 6–9, a level of 1000 millivolts may be chosen for cyan and 500 millivolts may be chosen for the other colors. This higher voltage level represents a second reflectivity for the glass beads.

I claim:

1. An inkjet printing system, comprising:

an inkjet printhead;

a pen housing having walls and configured to fluidically connect to said printhead;

a body of glass beads disposed in said pen housing;

ink disposed in said glass beads;

said glass beads having a first reflectivity when saturated with ink and a second reflectivity when not saturated with said ink;

a transparent window formed one of said walls of said pen housing to provide optical access to said glass beads; and an optical sensor optically coupled to said pen housing and configured to detect said first reflectivity and said second reflectivity and to output the results of said detection.

2. An inkjet printing system according to claim 1, further comprising:

an ink reservoir fluidically coupled to said pen housing and configured to supply additional ink into said pen housing.

3. An inkjet printing system according to claim 2, further comprising:

a valve fluidically coupled to said ink reservoir and configured to open to allow ink into said pen housing from said reservoir when said optical sensor senses said second reflectivity and to close to preclude ink from flowing from said reservoir when said optical sensor senses said first reflectivity;

wherein said ink reservoir is fluidically connected to said pen housing by means of a flexible tube.

4. An inkjet printing system according to claim 2, wherein said printing system is configured to intermittently fluidically connect said reservoir to said pen housing when said optical detector provides output that said glass beads have said second reflectivity.

5. An inkjet printing system, comprising:

a printer chassis;

an inkjet pen having a printhead and pen housing, said pen housing having walls, said pen being mechanically associated with said chassis to position said printhead proximate a print medium;

a body of glass beads disposed in said pen housing;

ink disposed in said body of glass beads;

said body of glass beads having a first reflectivity when saturated with ink and a second reflectivity when not saturated with said ink;

a transparent window formed one of said walls of said pen housing to provide optical access to said body of glass beads; and an optical sensor optically coupled to said pen housing and configured to detect said first reflectivity and said second reflectivity and to output the results of said detection.

6. An inkjet printing system according to claim 5, further comprising:

an ink reservoir fluidically coupled to said pen housing and configured to supply additional ink into said pen housing.

7. An inkjet printing system according to claim 6, further comprising:

a valve fluidically coupled to said ink reservoir and configured to open to allow ink into said pen housing from said reservoir when said optical sensor senses said second reflectivity and to close to preclude ink from flowing from said reservoir when said optical sensor senses said first reflectivity;

wherein said ink reservoir is fluidically connected to said pen housing by means of a flexible tube.

8. An inkjet printing system according to claim 6, wherein said printing system is configured to intermittently fluidically connect said reservoir to said pen housing when said optical detector provides output that said glass beads have said second reflectivity.

9. A method of providing ink to an inkjet printhead, comprising the steps of:

filling ink into a body of glass beads, which are fluidically coupled to said printhead;

optically monitoring the reflectivity of said body of glass beads;

optically detecting a change in reflectivity of said body of glass beads when ink in said body of glass beads is depleted and producing an electronic signal to indicate said change in reflectivity; and filling ink again into said body of glass beads based on said signal.

10. A method according to claim 9, wherein said steps of filling are performed from a reservoir through a tube fluidically coupled to said glass beads.

11. A method according to claim 9, wherein said steps of filling ink are performed from a reservoir which is intermittently fluidically coupled to said glass beads.

* * * * *

UNITED STATES PATENT AND TRADEMARK OFFICE

CERTIFICATE OF CORRECTION

PATENT NO. : 6,302,503 B1
DATED : October 16, 2001
INVENTOR(S) : Seu

It is certified that error appears in the above-identified patent and that said Letters Patent is hereby corrected as shown below:

Column 6,
Line 32, after "formed" insert -- in --.

Column 7,
Line 4, after "formed" insert -- in --.

Signed and Sealed this

Sixth Day of May, 2003

JAMES E. ROGAN
*Director of the United States Patent and Trademark Office*